US005261744A

United States Patent [19]

Brunn

[11] Patent Number: 5,261,744

[45] Date of Patent: Nov. 16, 1993

[54] MIXING APPARATUS

[75] Inventor: Randy J. Brunn, Brooklyn Park, Minn.

[73] Assignee: Red Devil Equipment Company, Bloomington, Minn.

[21] Appl. No.: 4,810

[22] Filed: Jan. 15, 1993

[51] Int. Cl.[5] ..... B01F 9/00

[52] U.S. Cl. ..... 366/217; 366/605

[58] Field of Search ..... 366/208, 209, 213, 214, 366/217, 220, 605, 218, 216, 219

[56] References Cited

U.S. PATENT DOCUMENTS 4,281,936 8/1981 Schotter ..... 366/209

4,789,245 12/1988 Morbeck ..... 366/605

5,050,996 9/1991 Allen ..... 366/605

*Primary Examiner*—Robert W. Jenkins

*Attorney, Agent, or Firm*—Dorsey & Whitney

[57] ABSTRACT

A mixing apparatus for providing gyroscopic movement to a mixing container via a direct drive system including a fixed ring gear, a planetary gear engaging the ring gear and a mechanism for rotating the container both about a center drive axis and an orbiting axis which is angularly displaced from the center drive axis. The invention also relates to a mechanism for facilitating insertion and removal of the container from the mixing apparatus including a mixer chassis and a top lid and lid closure assembly which are pivotally connected to a portion of the mixer chassis.

21 Claims, 4 Drawing Sheets

MIXING APPARATUS

BACKGROUND OF THE INVENTION

1. Field of the Invention

The present invention relates generally to the field of mixing apparatus, and more particularly to a mixing apparatus for liquids such as paint or the like.

2. Background of the Invention

A variety of paint mixers currently exist in the art. These range from paint mixers for relatively small paint cans ranging in size from one half pint to one gallon to heavy duty size mixers for mixing paint contained in five gallon pails. The mixers for smaller paint cans are those of the type generally found in retail stores where paint is sold. These mixers tend to be oscillatory or vibrating mixers which shake the can back and forth until the desired degree of mixing is obtained. The heavy duty industrial type paint mixers generally involve mixing motions other than simple oscillatory or vibrating movements. In fact many provide so-called gyroscopic movement of the paint can which rotates the paint can about a generally lateral axis, while simultaneously spinning the can about an axis perpendicular to the lateral axis. Such gyroscopic movement is generally accepted as the movement which provides the greatest mixing efficiency.

Existing apparatus for accomplishing such gyroscopic movement for heavy duty, industrial type mixers include a motor or other drive means and a plurality of drive belts for transferring the rotational motion of the motor shaft to the above axes for simultaneously rotating and spinning the can about those axes. Although these existing gyroscopic mixers provide generally acceptable mixing, maintenance costs tend to be a significant factor because of the relatively short life span of the drive belts. This is a particularly significant factor when the mixer is being used for heavy duty applications. In addition to the actual cost and expense relating to replacement of the belts, a cost is also associated with the downtime of the mixer during such replacement. Further, although unexpected downtime can be minimized with regular maintenance, the possibility continues to exist that a belt will unexpectantly break, resulting in unexpected downtime and inconvenience.

Present pain mixers, both those designed for smaller cans as well as those designed for heavy duty application, are provided with paint can clamping or gripping members which include a bottom pallet and a top lid which are moved vertically relative to one another to clamp or release a paint can. In other words, to clamp the paint can between the pallet and lid, the lid is moved vertically downwardly, usually as a result of rotating a threaded member, until the lid engages the top of the paint can and clamps the can between the lid and the pallet. After the mixing is complete, the lid is moved vertically away from the top of the paint can so that the paint can be removed. Usually the lid is raised just enough to allow the paint can to be removed in a generally lateral or horizontal direction relative to the axial axis of the paint can.

This is generally not a problem with respect to smaller paint cans of one gallon and smaller. However, it is a much greater problem with larger paint cans such as five gallon cans. A five gallon can, filled with paint, can weigh as much as 100 pounds. Thus, it is often difficult for the operator of the mixer to lift the can vertically and then move it horizontally into the relatively small area between the pallet and the lid. One limited solution to this problem is to raise the lid vertically as high as possible to provide a greater area within which to set the can between the pallet and the lid. However, this requires a larger apparatus to accommodate the additional desired movement of the lid, and also requires additional time to raise and lower the lid to provide such additional space. Even with this additional vertical movement of the lid, there is a limit to the advantages that can be obtained.

Accordingly, there is a need in the art for mixing apparatus, and particularly a paint mixer designed for heavy duty industrial or commercial applications which minimizes, if not eliminates, the maintenance problems that exist with current mixers. A need also exists for a mixing apparatus which provides an easier and improved means for introducing a paint can into, and removing a paint can from, the area between the pallet and the lid.

SUMMARY OF THE INVENTION

In contrast to the prior art, the present invention provides a mixing apparatus for paint or the like, and more particularly, a paint mixing apparatus providing so-called gyroscopic type movement which is designed particularly for heavy duty industrial or commercial use. In general, the paint mixer of the present invention utilizes a plurality of gears to provide a direct drive between the drive motor and the various rotating movements. This virtually eliminates unexpected breakdowns of the apparatus, particularly of the type prevalent in the prior art as a result of belt wear or breakage and significantly reduces the maintenance that is required. The result is a more reliable, cost effective mixing apparatus which substantially eliminates unexpected down time and the resulting inconvenience. The mixing apparatus of the present invention also provides an improved mechanism for clamping the paint can between the pallet and the lid which enables the paint can to be more easily inserted into and removed from such mechanism.

More specifically, the mixing apparatus of the present invention includes a support frame, a fixed ring gear connected with the support frame and a mixer chassis carrying a paint can clamp or gripping means for rotation about a center drive axis. The gripping means includes a bottom pallet and a top lid mounted for spinning movement relative to the mixer chasis. Such apparatus further includes a planetary gear which orbits about the ring gear and a pair of bevel gears for transmitting the rotational movement of the planetary gear to spin the pallet and lid around an axis which in turn rotates about the drive axis. Such gear means provides a direct drive system which totally eliminates drive belts and thus the maintenance problems associated with them.

The improved clamping mechanism for the mixing apparatus includes a lid which, instead of being moved vertically along the axial axis of the can to clamp or release the lid as in the prior art, is pivoted forwardly and rearwardly about one or more pivot axes generally orthogonal to the axial axis of the can. This structure facilitates movement of the lid upwardly and away from the can when it is released. This in turn allows the can to be inserted into, and removed from, the clamping area via substantially vertical or vertical/horizontal movement.

Accordingly, it is an object of the present invention to provide an improved mixing apparatus which overcomes the maintenance problems of prior art mixers.

Another object of the present invention is to provide a mixing apparatus with gyroscopic movement utilizing a direct drive to minimize, if not eliminate, maintenance problems.

Another object of the present invention is to provide a paint mixing apparatus for heavy duty applications involving a direct gear drive with the elimination of drive belts.

A further object of the present invention is to provide a mixing apparatus with an improved container clamping mechanism which facilitates easier insertion and removal of the container from such mechanism.

A still further object of the present invention is to provide a mixing apparatus, and more particularly a paint mixing apparatus, in which the clamping mechanism includes a lid which is pivotable between a closed and an open position.

These and other objects of the present invention will become apparent with reference to the drawings, the description of the preferred embodiment and the appended claims.

DESCRIPTION OF THE PREFERRED EMBODIMENT

Figure 1:
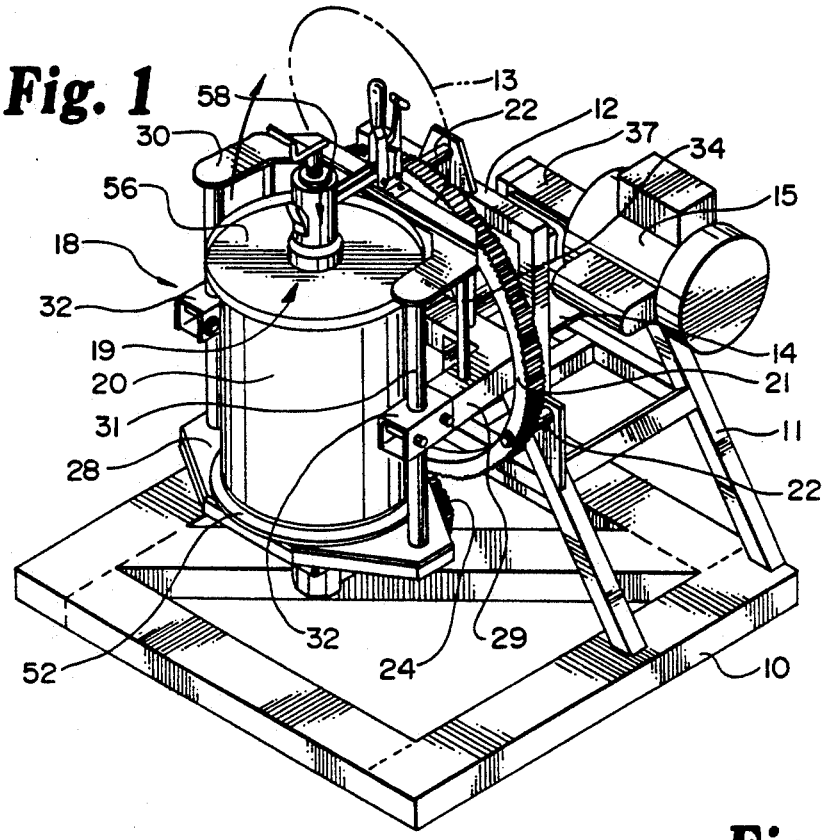
FIG. 1 is a perspective view of the mixing apparatus of the present invention.

Reference is first made to FIG. 1 showing a perspective view of the mixing apparatus of the present invention. Although the preferred embodiment of the apparatus is intended primarily as a paint mixer and primarily as a paint mixer for larger cans, such as five gallon cans of paint, the apparatus can be used for mixing various other materials including not only other liquid materials but granular or powdered materials as well. Further, the mixing apparatus is designed to provide so-called gyroscopic mixing movement involving both rotational and spinning movement of the can about axes which are generally orthogonal or perpendicular with respect to one another. With the structure of the preferred embodiment, however, various modified gyroscopic mixing movement can be provided as well. Such modified movement is provided by rotation and spinning movement about axes which are angularly displaced, but are not orthogonal to one another.

The mixing apparatus of the present invention includes a support base 10 and a support frame which comprises the ring gear support frame 12, the motor support platform 14 and various struts or other frame elements 11 connecting the frame members 12 and the platform 14 with the base 10. The apparatus of the present invention also includes a drive motor and various mechanisms for clamping a can of paint within the apparatus and for providing generally gyroscopic mixing movement thereto. These include a direct drive gear assembly 16, a rotatable mixer chassis 18 and a lid closure or clamp assembly 19 for clamping or gripping engagement with a container 20 of material to be mixed.

Figure 2:
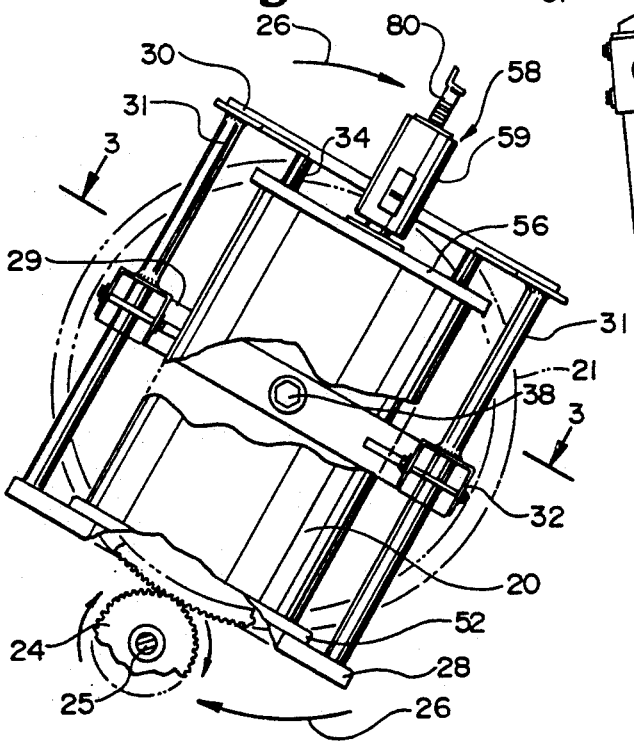
FIG. 2 is an elevational front view, with sections broken away, of a portion of the mixing apparatus of the present invention showing rotational movement of the mixer chassis and the planetary gear about the fixed ring gear.
Figure 3:
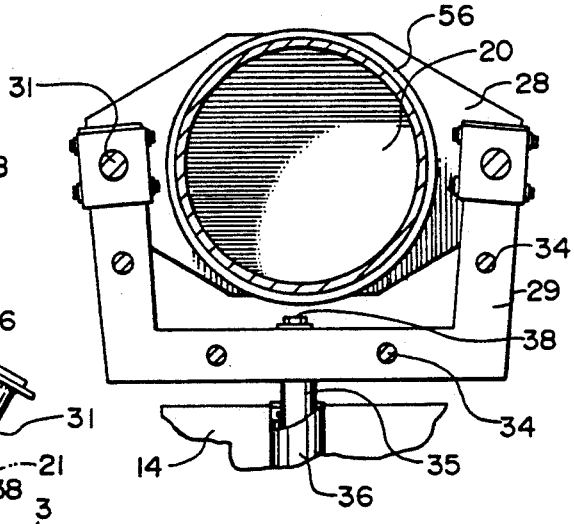
FIG. 3 is a view, partially in section, as viewed along the section line 3—3 of FIG. 2.

The chassis assembly 18 is illustrated best in FIGS. 1, 2 and 3 and includes a chassis base 28, a centrally positioned drive yoke 29 and an upper lid support yoke 30. A pair of truss elements 31 extend between the base 28 and the support yoke 30 and are connected to bifurcated ends of the drive yoke 29 by the brackets 32. A plurality of additional support posts 34 extend between the upper lid support yoke 30 and the drive yoke 29 to provide additional support structure. With this construction, the base 28, the drive yoke 29, the lid support yoke 30 and truss elements 31 and support posts 34 are maintained in a rigid configuration.

As shown best in FIG. 3, the rearward end of the drive yoke 29 is rigidly joined with a drive shaft 35 which extends from a cylinder support bearing 36 and a speed reducer and differential mechanism 37 (FIG. 1). In the preferred embodiment, the shaft 35 may be rigidly connected with the drive yoke 29 via welding or via a cap screw 38 with a washer as illustrated. During operation of the mixing apparatus, the mixer chassis 18 is rotated with the shaft 35 via the drive motor 15 and through the speed reducer mechanism 37 and the bearing support 36. The shaft 35 accordingly defines the center or center rotational axis of the chassis 18.

As illustrated best in FIGS. 1 and 2, the gear assembly 16 includes a ring gear 21 having a plurality of external gear teeth arranged in a generally circular configuration. The ring gear 21 is rigidly mounted in a fixed position relative to the ring gear frame 12 by a plurality of support posts or standoffs 22 positioned around the periphery of the gear 21. Although the preferred embodiment illustrates the gear 21 as having external teeth, the advantages of the present invention can be also achieved with a similar gear being provided with internal teeth arranged in a generally circular configuration. Further, although the preferred embodiment shows the gear 21 as a ring gear having a generally annular configuration, it could also embody other configurations. However, the teeth should be arranged in a generally circular path around a center axis.

A planetary gear or pinion 24 is associated with the ring gear 21 and includes a plurality of external teeth which engage the outer teeth of the gear 21. The planetary gear 24 is supported on and rigidly connected with a planetary gear shaft 25 which in turn is supported by a portion of the mixer chassis 18. Rotation of the chassis 18 on the shaft 35, and thus movement of the planetary gear 24 in an orbiting movement around the ring gear 21, causes corresponding rotation of the planetary gear 24 with the planetary gear shaft 25. In the preferred embodiment, the mixer chassis 18 moves in a clockwise direction as viewed in FIG. 2 and as shown by the directional arrows 26. This results in counterclockwise rotation of the gear 24 with its shaft 25. In the preferred embodiment, the shaft 35, and thus the chassis is rotated at about 60–90 rpm, while the gear ratio between the gear 21 and the gear 24 causes the gear 24 to rotate at about four times that speed.

Figure 7:
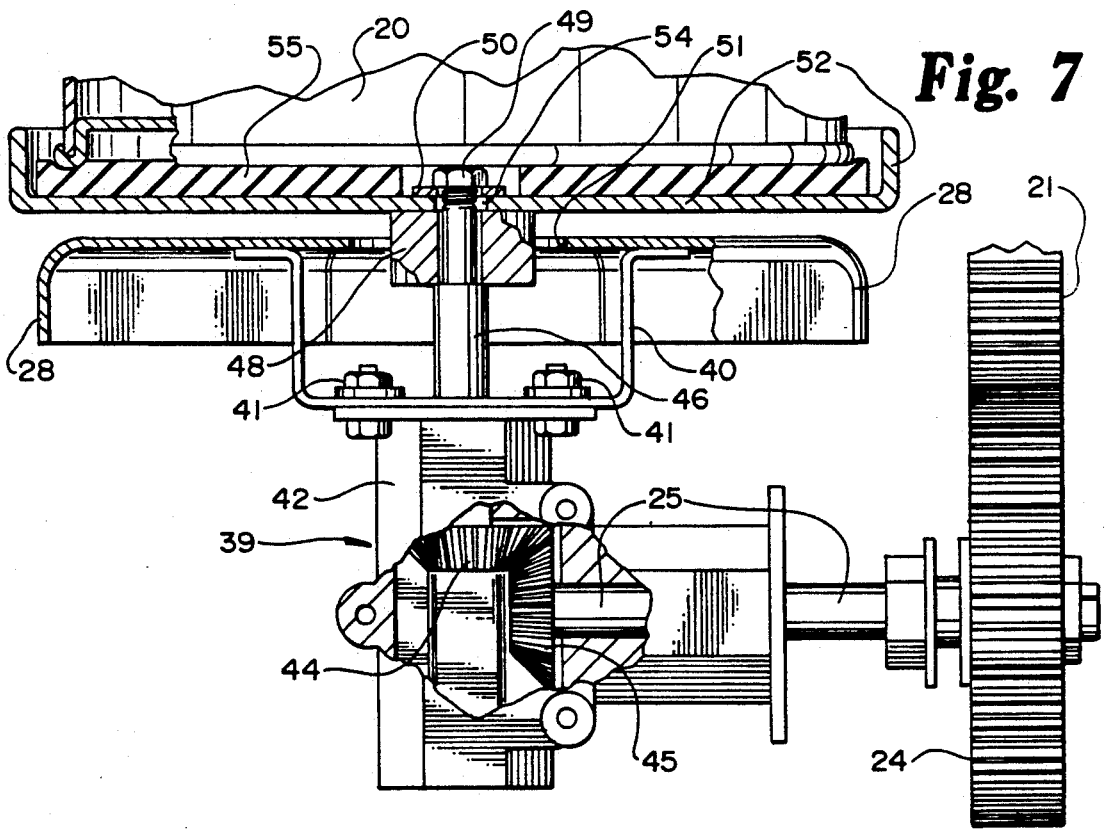
FIG. 7 is a side elevational view, partially in section, and with parts broken away, showing the planetary gear, the pallet and the means for transmitting rotational movement of the planetary gear to the pallet.

FIG. 7 illustrates the connection between a portion of the mixer chassis 18 and the planetary gear 24. Specifically, the base 28 of the mixer chassis 18 is connected with the planetary gear 24 via the gear differential assembly 39 and the bracket 40. The bracket 40 is a generally U-shaped member having a pair of legs with outwardly extending tabs joined to a portion of the bottom surface of the base 28 by welding or the like. The U-shaped portion of the bracket 40 is connected with a portion of the gear differential assembly 39 by a plurality of threaded members 41. The gear differential assembly 39 includes a pair of bevel gears 44 and 45 within the gear box housing 42. As shown, the bevel gear 45 is carried on one end of the planetary gear shaft 25 which extends through and is supported by one end of the gear box 42. The other bevel gear 44 is carried on one end of a pallet drive shaft 46 which extends through a second end of the gear box 42, and through an opening in the bracket 40. The other end of the shaft 46 opposite the bevel gear 44 is provided with a hub 48 and internal threads for receiving a cap screw retaining bolt 49.

The shaft 46 and hub 48 extend upwardly through an opening or clearance hole 51 in the base 28 for connection with a bottom pallet 52. The pallet 52 includes a center opening 54 and is joined with the shaft 46 and hub 48 by the retaining bolt 49 extending through the opening 54 and into the internally threaded shaft 46 and hub 48. A washer 50 is positioned between the head of the bolt 49 and a portion of the pallet 52. The bottom inside surface of the pallet 52 is provided with a rubber or other similarly compressible material base 55 for supporting the paint can 20. With this construction, rotation of the planetary gear 24 causes rotation of the shaft 25. This in turn causes corresponding rotation of the shaft 46 through the bevel gears 44 and 45 and thus rotation of the pallet 52 and the can 20. In the preferred embodiment, the shaft 46 is generally orthogonal or perpendicular to the shaft 25 and the center axis 35 and defines an orbiting axis about which the pail 20 spins as it rotates or tumbles about the axis 35.

The preferred embodiment contemplates a fixed ring gear 21 and a planetary gear or pinion 24 with straight teeth generally parallel to their respective parallel axes. Similar motion transfer can, however, be obtained with helical gear teeth, with bevel gears in combination with straight or spiral gear teeth or various other gear and gear teeth configurations. Further, as stated above, the gear 21 could be a gear with internal teeth rather than the external teeth as shown. Thus, the term gear or gear means as used herein is intended to cover such other configurations.

Further, the center axis 35 and the planetary gear shaft 25 are shown as being generally parallel to each other and the orbiting axis defined by the shaft 46 is shown as being perpendicular to both the axis 35 and the shaft 25. With the structure of the present invention, however, it is contemplated that these relationships can be altered. For example, by appropriately machined bevel gears or the like, the axis 35 and shaft 25 can be altered to an angular, non-parallel position. Similarly, the relationship between the shaft 46 and the shaft 25 can be altered to a position which is not perpendicular. Such alteration can be made to maximize mixing efficiency for a particular container or to provide desired mixing motion.

Figure 4:
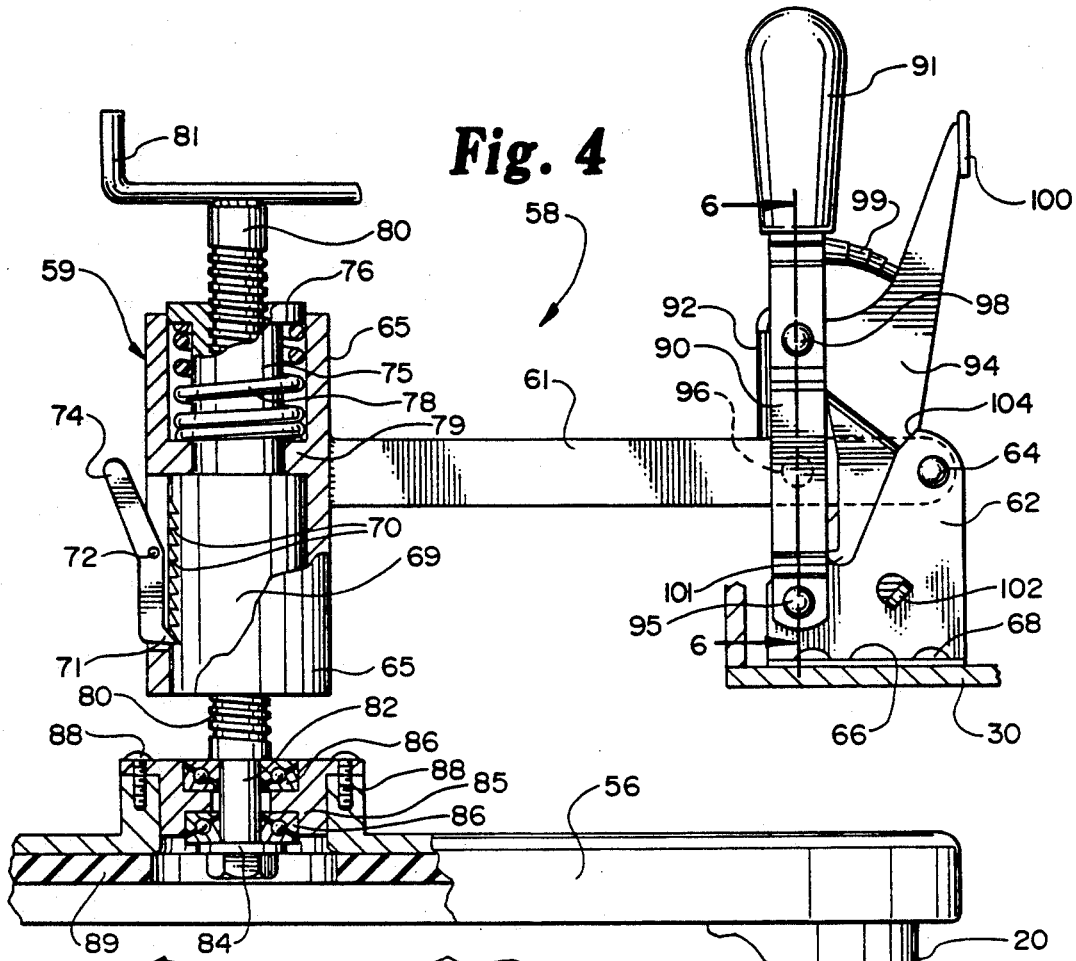
FIG. 4 is a side elevational view, partially in section, of a portion of the lid closing assembly shown in a closed position.

The clamp means 19 (FIG. 1) for clamping a pail or container 20 of the material to be mixed to the mixer chassis 18 includes a gripping means comprised of the pallet 52 and the lid 56 and a lid closure assembly illustrated generally in FIGS. 1 and 4 by the reference character 58. As illustrated best in FIG. 4, the lid closure assembly 58 includes a lid adjustment means 59 and a lock mechanism 60 rigidly connected with the top surface of the lid support yoke 30. The lid assembly 58 further includes a connecting arm 61 having one end pivotally secured to a clamp support bracket 62 about the pivot point 64 and the opposite end rigidly connected with the ratchet housing 65 of the lid adjustment means 59. In the preferred embodiment, the clamp support bracket 62 is provided with a pair of outwardly extending flanges 66 for connection with the lid support yoke 30 via the connection members 68.

The lid adjustment means 59 of the preferred embodiment includes an outer ratchet housing 65 which is joined to an end of the connecting arm 61 via welding or the like and an internal ratchet body 69 having a plurality of ratchet teeth 70 along one side for engagement by the ratchet dog 71 of the ratchet lever 74. The ratchet lever 74 is pivotable about the point 72 and enables the dog 71 to engage the teeth 70. The ratchet teeth 70 are configured so that upward movement of the ratchet body 69 relative to the housing 79 will be precluded as a result of engagement between the dog 71 and one of the ratchet teeth. Downward movement of the ratchet body 69 relative to the ratchet housing 65, however, will be permitted. Integrally formed with the ratchet body 69 is a spring support portion 75 and an end flange 76. A coil spring 78 is positioned around the spring body and between the flange 76 and an inwardly extending shoulder 79 of the housing 65. With this construction, the spring 78 biases the ratchet body 69 upwardly relative to the housing 65 as a result of engagement between the dog 71 and one of the teeth 70.

A lead screw 80 with ACME threads is threadedly received by internal ACME threads provided in the ratched body 69. The screw 80 extends through the length of the body 69 and exits the opposite end where it is rotatably connected to the lid 56 through a thrust bearing assembly 85 embodying a plurality of thrust bearings 86. The outer race of these bearings 86 is connected with the lid 56 via the threaded members 88, while the inner race of the bearings 86 is connected with the lead screw 80 via the retainer bolt 82. The bolt 82 extends through the bearing assembly 85 and into the lead screw 80 where it is retained by internal threads. A washer 84 is positioned between the head of the retainer bolt 82 and the bearing assembly 85. Similar to the pallet 52 described above with respect to FIG. 7, the inner surface of the lid 56 is provided with a rubber or other similar compressibility material base 89 for clamping against the paint can or other container 20.

The vertical position of the lid 56 relative to the top of the paint can 20 can be adjusted using the mechanism 59 as follows. If the lid 56 is further from the top of the can than the length of one of the ratchet teeth 70, the entire ratchet body 69, including the lead screw 80 can be manually moved downwardly against the force of the spring 78 until the surface of the rubber layer 89 engages the top of the paint can 20. At this point, the ratchet dog 71 will be in engagement with one of the ratchet teeth 70. Further, tightening adjustment can then be made by rotating the screw 80 utilizing the crank 81. This results in final gripping and clamping engagement between the lid 56 and the top of the can 20. When this occurs, the can 20 is captured between the lid 56 and the pallet 52.

Figure 8:
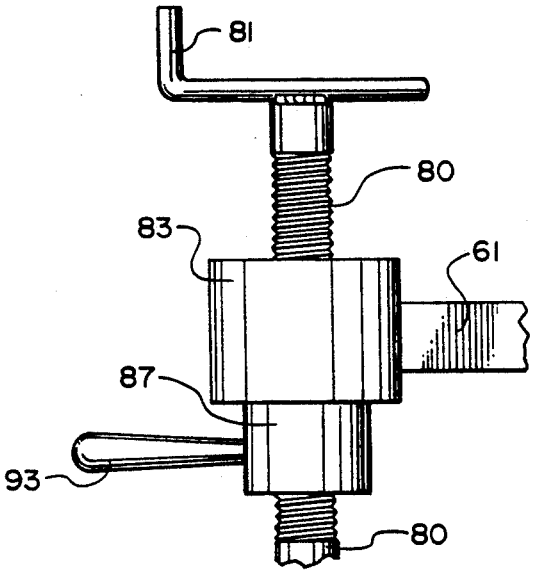
FIG. 8 is a side elevational view of an alternate mechanism for vertically adjusting the lid.

An alternate lid adjusting means is illustrated in FIG. 8. As shown, the principal difference between the adjustment means of FIG. 8 and the adjustment means 59 of FIG. 4 is that the adjustment means of FIG. 8 does not include the ratchet mechanism. The mechanism of FIG. 8 includes an internally threaded body 83 rigidly connected to one end of the connecting arm 61. The body 83 includes internal threads to receive the lead screw 80. Associated with the member 83 is an internally threaded lock nut 87 having a locking arm 93. To secure the lid 56 to the paint can using the embodiment of FIG. 8, the crank 81 is rotated until the lid has been sufficiently lowered to tightly engage the top of the can 20. When this is done, the lock nut 87 is rotated by the arm 93 so that it locks against the member 83.

Associated with the adjustment means 59 and pivotally connected at the other end of the connecting arm 61 is the lock mechanism 60. As illustrated best in FIGS. 4, 5 and 6, the locking mechanism includes a support bracket 62, a pivot lever 90 with a lever handle 91, a motion transfer link 92 and a lock member 94. The bracket 62 includes a pair of spaced side portions, each of which includes a bottom, outwardly extending flange 66 which is connected to the lid support yoke 30 via a plurality of threaded members 68. The pivot lever 90 includes a pair of spaced apart, bifurcated portions 90*a* and 90*b* which are pivotally secured at their lower ends to the bracket 62 about the pivot pin 95.

The motion transfer or toggle link 92 includes spaced apart sides 92*a*, 92*b* (FIG. 6) and is pivotally connected at one end to the connecting arm 61 about the pivot point 96. The other end of the link 92 is pivotally secured to the lever arm 90 about the pivot pin 98. The lock member 94 is pivotally connected relative to both the link 92 and the lever arm 90 about the pivot point 98 and includes a centrally positioned lock surface 104, a lower latch end 101 and a top lock release tab 100. Preferably a spring or other bias member 99 is positioned between the lever arm 90 and the lock member 94 to bias the lock member in a generally clockwise direction relative to the lever arm 90 as viewed in FIGS. 4 and 5. Each side of the lower end of the bracket 62 is provided with a latch tab or dog 102 for receiving the latch member 101 to retain the lock assembly 60, and thus the lid closure assembly, in an open position as illustrated in FIG. 5.

Figure 5:
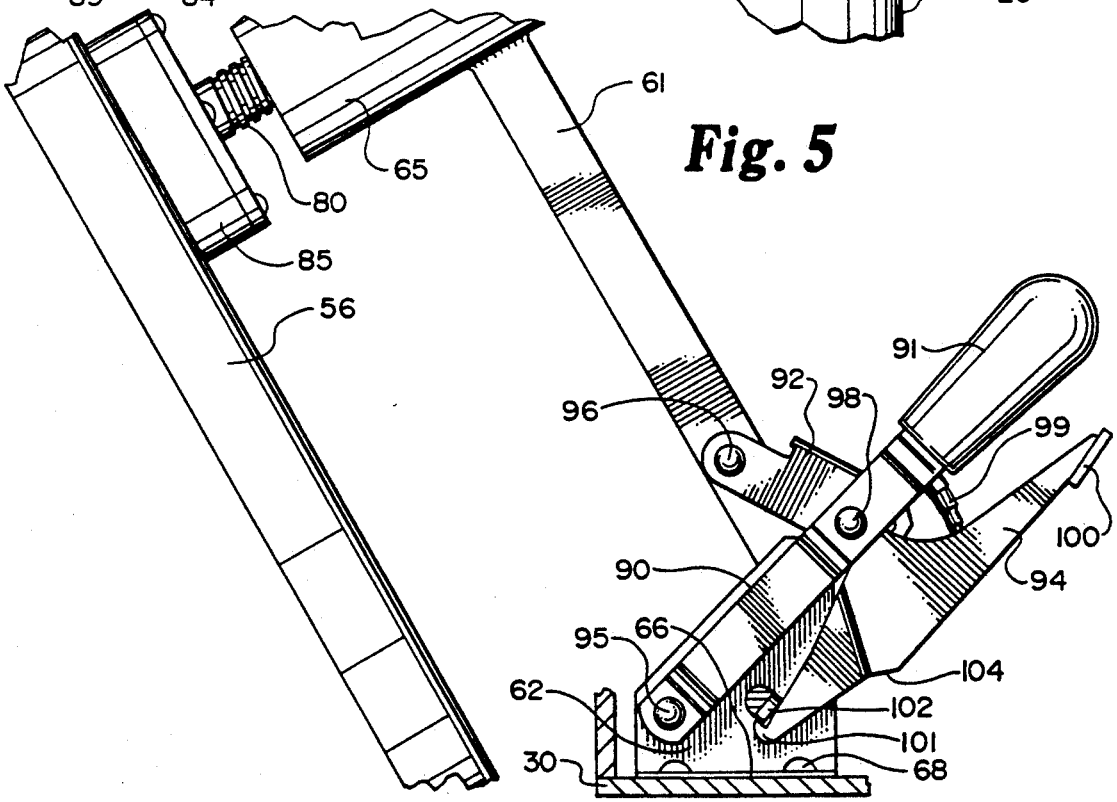
FIG. 5 is a side elevational view, similar to a portion of FIG. 4, showing the lid closure assembly in an open position.

The structure of the lock assembly 60 facilitates the pivotal movment of the lid closure assembly between a closed position illustrated in FIGS. 1 (solid lines) and 4 and an open position 13 illustrated in FIG. 1 (phantom lines) and FIG. 5. Such pivotal movement occurs as a result of pivotal movement of the connecting arm 61 about the pivot point 64. To cause such pivotal movement, the lock member 94 is first pivoted in a counterclockwise direction relative to the lever arm 90 by moving the locking tab 100 toward the handle 91 against the force of the spring 99. This movement disengages the locking seat 104 from its corresponding bracket seat and allows the lever arm 90 to be rotated rearwardly (toward the right as viewed in FIG. 4) about the pivot 95. This movement causes clockwise pivotal movement of the connecting arm 61 about the pivot 64 as a result of the motion transfer link 52. When the lid is sufficiently opened, the locking tab 100 is released, thereby allowing the latch member 101 to engage the dog 102 as illustrated in FIG. 5. This retains the lid assembly in its open position and allows paint cans to be removed from or placed onto the pallet 52. After a paint can has been placed on the pallet, the locking tab 100 is again rotated in a counterclockwise direction toward the lever arm 90. This releases the latch 101 from the dog 102 and allows the lever arm 90 and the lid closure assembly 58 to pivot into the closed position as illustrated in FIGS. 1 and 4. The adjustment means 59 is then used to tighten the lid 56 against the top of the paint can.

Figure 6:
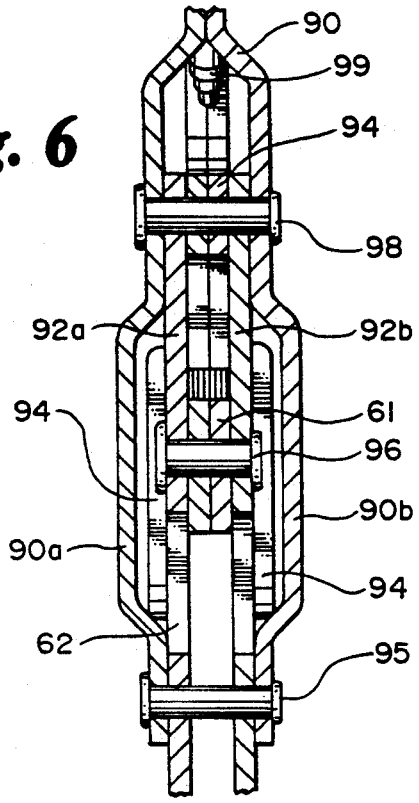
FIG. 6 is a view, partially in section, as viewed along the section line 6—6 of FIG. 4.
Figure 11:
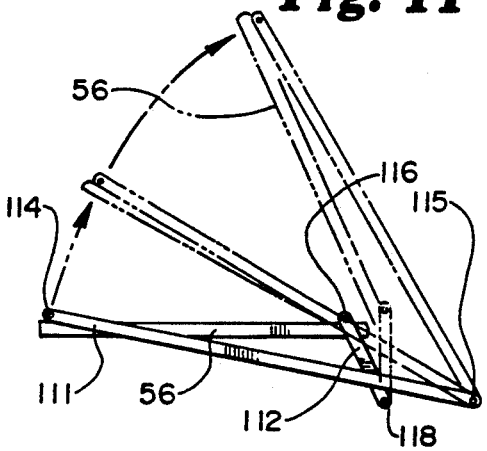
FIG. 11 is a side elevational view of an alternate lid closure assembly in which the lid is pivotable about two pivot points.

The preferred embodiment contemplates a lid closure assembly with a single pivot point 64 as shown in FIGS. 5 and 6. Such pivot causes upward and rearward movement of the lid between a closed and an open position. Upward and rearward movement can also be provided with a pair of pivot points such as is shown in the alternate embodiment of FIG. 11. In FIG. 11, the lid 56 is pivotally connected relative to a portion of the chassis about the pivot points 118 and 115. Such pivotal connection is via the connecting links 111 and 112 which are pivotally connected at one of their ends to the lid 56 at the points 114 and 116, respectively, and pivotally connected at their opposite ends to the points 118 and 115, respectively. The links 111 and 112 can be oriented as shown or can be a parallelogram type linkage.

Figure 9:
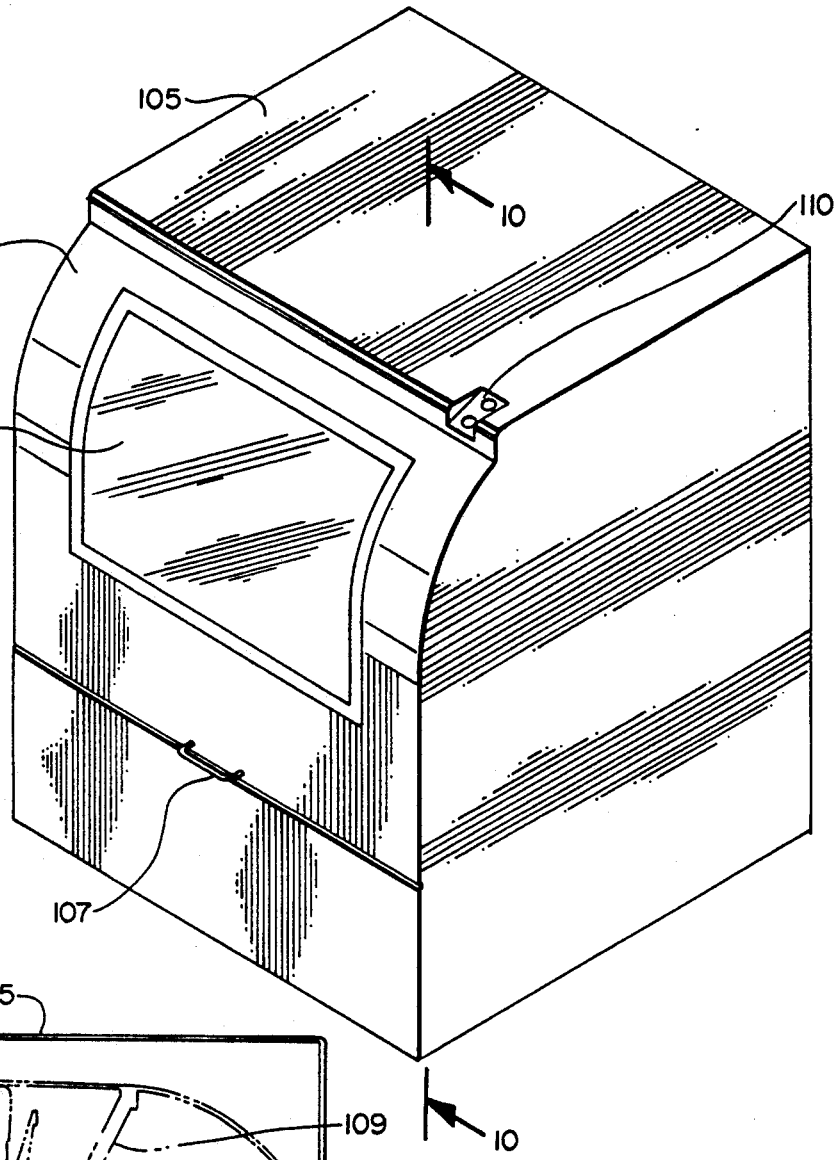
FIG. 9 is a perspective view of a cabinet for the mixing apparatus of the present invention.
Figure 10:
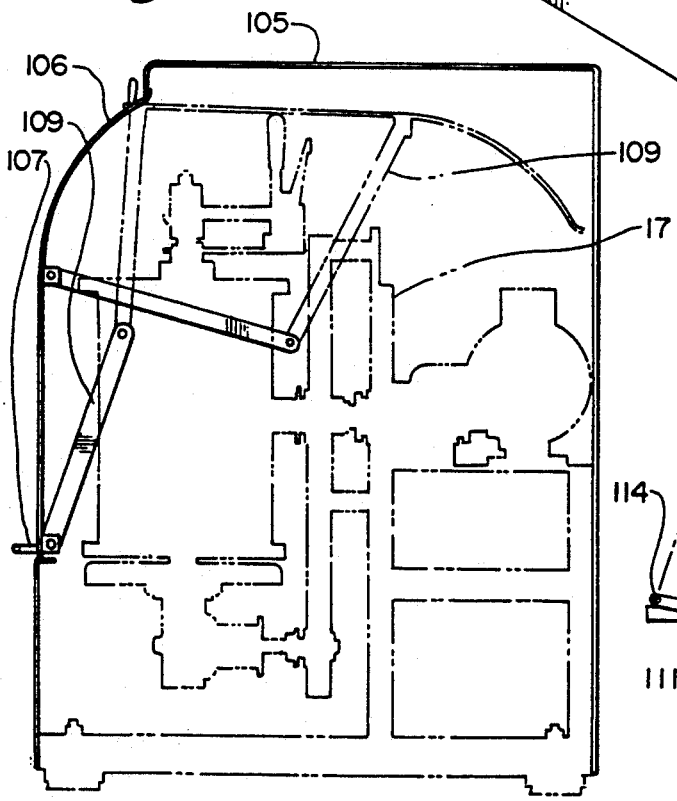
FIG. 10 is a view, partially in section, as viewed along the section line 10—10 of FIG. 9 and showing the mixing apparatus in phantom.

The commercial embodiment of the mixing apparatus of the present invention contemplates enclosing the apparatus within a housing or cabinet 105 illustrated in FIGS. 9 and 10. Preferably, the cabinet 105 is provided with a forward door 106 and an external on/off switch 110. The door 106 is preferably provided with a transparent window 108 so that the mixing apparatus (illustrated in phantom by reference character 17) can be viewed while in operation. As shown best in FIG. 10, the door 106 is opened and closed using the bracket members 109 and the handle 107.

Having described the structure of the present invention in detail, the overall function is described as follows. First, with the lid closure assembly in an open position as viewed in the phantom lines 13 of FIG. 1 and in FIG. 5, a paint can is inserted into the mixing apparatus. Because the lid closure assembly is pivoted upwardly and rearwardly relative to the lid support yoke 30, the paint can 20 can be placed onto the pallet 52 by generally vertical, or combined vertical/horizontal movement. This is a particular advantage when handling relatively large containers such as five gallon cans of paint. When the can 20 is seated on the pallet 52, the latch 101 (FIG. 5) is removed from the dog 102, allowing the lid assembly to pivot downwardly so that the lid 56 is positioned vertically above the top of the can 20. The adjustment means 59 is then utilized to tighten the lid 56 against the top of the can 20 as previously described and to thereby capture the paint can 20 between the lid 56 and the pallet 52. When in this position, the locking seat 104 of the lock member 94 engages a corresponding seat portion of the bracket 62 and prevents inadvertent release of the lid closure assembly 58.

Having positioned a paint can within the mixing apparatus, the door 106 (FIGS. 9 and 10) is closed and the switch 110 (FIG. 9) is activated. This results in rotational movement of the drive shaft 35 which in turn causes rotational movement of the entire mixer chassis 18. Such rotational movement of the mixer chassis 18 causes the planetary gear 24 to revolve around the fixed, ring gear 21 which in turn imparts a direct drive spinning movement to the can 20 through the shafts 25 and 46 and the bevel gears 44 and 45 as shown in FIG. 7. Thus, the mixing motion of the mixing apparatus of the present invention involves the so-called gyroscopic movement in which the paint can is simultaneously rotated about a generally horizontal center drive axis as well as spinning about an axis which rotates about the center drive axis. In the preferred embodiment, the center drive axis and the spinning or orbiting axis are generally orthogonal, or perpendicular, to one another. However, with the apparatus of the present invention the relative angular position of these axis can be altered if desired, to maximize the mixing movement or to obtain desired mixing movement.

When the mixing is completed, the switch 110 is deactivated and the door 106 is opened. The lock member 101 is then released to allow the lid closure assembly 58 to be moved to its open position. The paint can 20 can then be lifted off the pallet and out of the mixing apparatus in a generally vertical or combined vertical/-horizontal movement.

Although the description of the preferred embodiment has been quite specific, it is contemplated that various modifications could be made without deviating from the spirit of the present invention. Accordingly, it is contemplated that the scope of the present invention be dictated by the appended claims rather than by the description of the preferred embodiment.

I claim:

1. A mixing apparatus comprising:

a support frame;

a fixed gear connected with said support frame and having gear teeth arranged in a generally circular path around a first axis;

a mixer chassis carrying clamp means for holding a container of material to be mixed, said clamp means including container gripping means rotatable relative to said mixer chassis about a second axis for gripping engagement with the container of material to be mixed and a lid closure assembly connected with said gripping means for moving said gripping means between a closed position in which the container is in gripping engagement and an open position in which the container is released from gripping engagement;

first drive means for rotating said mixer chassis about said first axis; and second drive means carried by said mixer chassis for rotating said gripping means about said second axis, said second drive means including a planetary gear having gear teeth for engagement with the gear teeth of said fixed gear and a planetary gear shaft extending from said planetary gear, whereby said planetary gear and said planetary gear shaft rotate as said mixer chassis rotates about said first axis; and means connected with said planetary gear shaft and said gripping means for transmitting rotational movement of said planetary gear shaft to said gripping means.

2. The mixing apparatus of claim 1 being a paint mixer.

3. The mixing apparatus of claim 1 wherein said gripping means includes a bottom pallet and a top lid.

4. The mixing apparatus of claim 3 wherein said pallet is operatively connected with said means for transmitting rotational movement of said planetary gear shaft to said gripping means and said lid is rotatably connected relative to said lid closure assembly.

5. The mixing apparatus of claim 4 wherein said lid closure assembly is pivotally connected with said mixer chassis about a pivot axis orthogonal to said first axis.

6. The mixing apparatus of claim 1 wherein said fixed gear is a ring gear.

7. The mixing apparatus of claim 1 wherein said planetary gear shaft is generally parallel to said first axis.

8. The mixing apparatus of claim 7 wherein said second axis is generally orthogonal to, and intersects, said first axis.

9. The mixing apparatus of claim 8 wherein said means for transmitting rotational movement of said planetary gear shaft to said gripping means includes a pair of bevel gears, one of said bevel gears being rotatable with said planetary gear shaft and the other of said vevel gears rotatable with said gripping means about said second axis.

10. The mixing apparatus of claim 1 wherein said mixer chassis includes a base, a drive yoke and a lid support yoke.

11. A mixing apparatus comprising:

a support frame;

a mixer chassis rotatable about a first axis and carrying clamp means for holding a container of material to be mixed, said clamp means including container gripping means rotatable relative to said mixer chassis about a second axis for gripping engagement with the container of material to be mixed, said gripping means including a bottom pallet and a top lid;

first drive means for rotating said mixer chassis about said first axis;

second drive means for rotating said gripping means about said second axis; and said clamp means further including a lid closure assembly connected with said top lid and pivotally connected to said mixer chassis, whereby said lid closure assembly and said top lid connected thereto are pivotally movable between a closed position in which said lid is in gripping engagement with the container and an open position in which said lid is disengaged from the container.

12. The mixing apparatus of claim 11 wherein said lid closure assembly includes a lid adjustment means for positional adjustment of the top lid relative to the container.

13. The mixing apparatus of claim 12 wherein said lid closure assembly includes a connecting arm having a first end rigidly connected with said adjustment means and a second end pivotally connected with said mixer chassis.

14. The mixing apparatus of claim 13 wherein said lid closure assembly further includes pivot means for pivoting said connecting arm relative to said mixer chassis.

15. The mixing apparatus of claim 14 wherein said pivot means includes a lock mechanism of locking said lid closure assembly and said top lid in said closed position.

16. The mixing apparatus of claim 15 wherein said pivot means includes a toggle link assembly.

17. The mixing apparatus of claim 12 wherein said lid adjustment means includes a ratchet assembly.

18. The mixing apparatus of claim 17 wherein said lid adjustment means includes a ratchet assembly for initial adjustment and a threaded member assembly for final, gripping adjustment.

19. The mixing apparatus of claim 11 wherein said second drive means comprises a plurality of gears including a fixed gear supported by said frame and a planetary gear positioned for orbiting movement around said fixed gear.

20. The mixing apparatus of claim 19 wherein said second drive means further comprises a pair of bevel gears for transmitting rotational movement of said planetary gear to said gripping means.

21. The mixing apparatus of claim 11 wherein said top lid is pivotally connected to said mixer chassis at a pair of pivot points.

* * * * *